United States Patent [19]

Holmes et al.

[11] 4,133,281

[45] Jan. 9, 1979

[54] VACUUM CHARGING OF CONTAINERS FROM BULK SUPPLY

[75] Inventors: Gordon Holmes, Tenbury Wells; Geoffrey R. Martin, Bromyard, both of England

[73] Assignee: Albro Fillers and Engineering Company Ltd., Bromyard, England

[21] Appl. No.: 817,438

[22] Filed: Jul. 20, 1977

[51] Int. Cl.[2] ..... B65B 3/04

[52] U.S. Cl. ..... 141/1; 141/51; 141/89

[58] Field of Search ..... 141/1-12, 141/37-68, 89-92; 251/DIG. 4, 61.3, 5, 61.4

[56] References Cited

U.S. PATENT DOCUMENTS

| | | | |
|---|---|---|---|
| 2,642,215 | 6/1953 | Carter | 141/51 |
| 2,690,865 | 10/1954 | Fischer et al. | 141/51 |
| 2,815,621 | 12/1957 | Carter | 141/51 |
| 2,954,203 | 9/1960 | Carter | 141/51 |
| 3,517,907 | 6/1970 | Bach | 251/5 |
| 3,543,791 | 12/1970 | Fox et al. | 251/5 |
| 3,762,430 | 10/1973 | Maercklein | 251/61.3 |
| 3,874,629 | 4/1975 | Fontaine | 251/61.4 |
| 3,884,446 | 5/1975 | Erickson | 251/61.4 |
| 3,952,773 | 4/1976 | Hahn | 251/5 |

*Primary Examiner*—Houston S. Bell, Jr.
*Attorney, Agent, or Firm*—Lowe, King, Price & Becker

[57] ABSTRACT

A method of charging a container with a predetermined quantity of a fluent material includes the steps of connecting the container to a bulk supply of the material, applying a vacuum within the container at a predetermined pressure level and for a predetermined period of time determined by an electronic timer to draw a charge of material into the container, the quantity of said charge being determined as a function of said pressure level and said period, and vacuum purging surplus material from the connection between the container and the bulk supply on completion of a filling operation and before commencement of a succeeding filling operation.

11 Claims, 6 Drawing Figures

VACUUM CHARGING OF CONTAINERS FROM BULK SUPPLY

This invention relates to the packaging or batching of fluent materials by charging containers with predetermined quantities (weight or volume) of the material, with particular reference to the packaging of pulverulent materials; for example such household products as talcum powder or scouring powder.

The object of the invention is to provide a method and apparatus for such packaging which is reliable and accurate in operation, particularly in an automatic cycle, and which can be readily adapted to handle a range of materials, container types and sizes, and/or quantities of charge.

In one aspect the invention provides a method of charging a container with a predetermined quantity of a fluent material including the steps of connecting the container to a bulk supply of the material and applying a vacuum within the container at a predetermined pressure level and for a predetermined period of time to draw a charge of material into the container, the quantity of said charge being determined as a function of said pressure level and said period.

In another aspect the invention provides apparatus for charging a container with a predetermined quantity of a fluent material including a filling head operable to connect a mouth of the container with a bulk supply of the material, means for applying a vacuum within the container at a predetermined pressure level whereby material is drawn into the container from the supply, and timing means for controlling the period of time during which said vacuum is applied, said pressure level and said period being preselected so as to determine the size of the charge of material.

A preferred embodiment of the invention in the form of an automatic single head filling machine is now more particularly described with reference to the accompanying drawings wherein.

Figure 1:
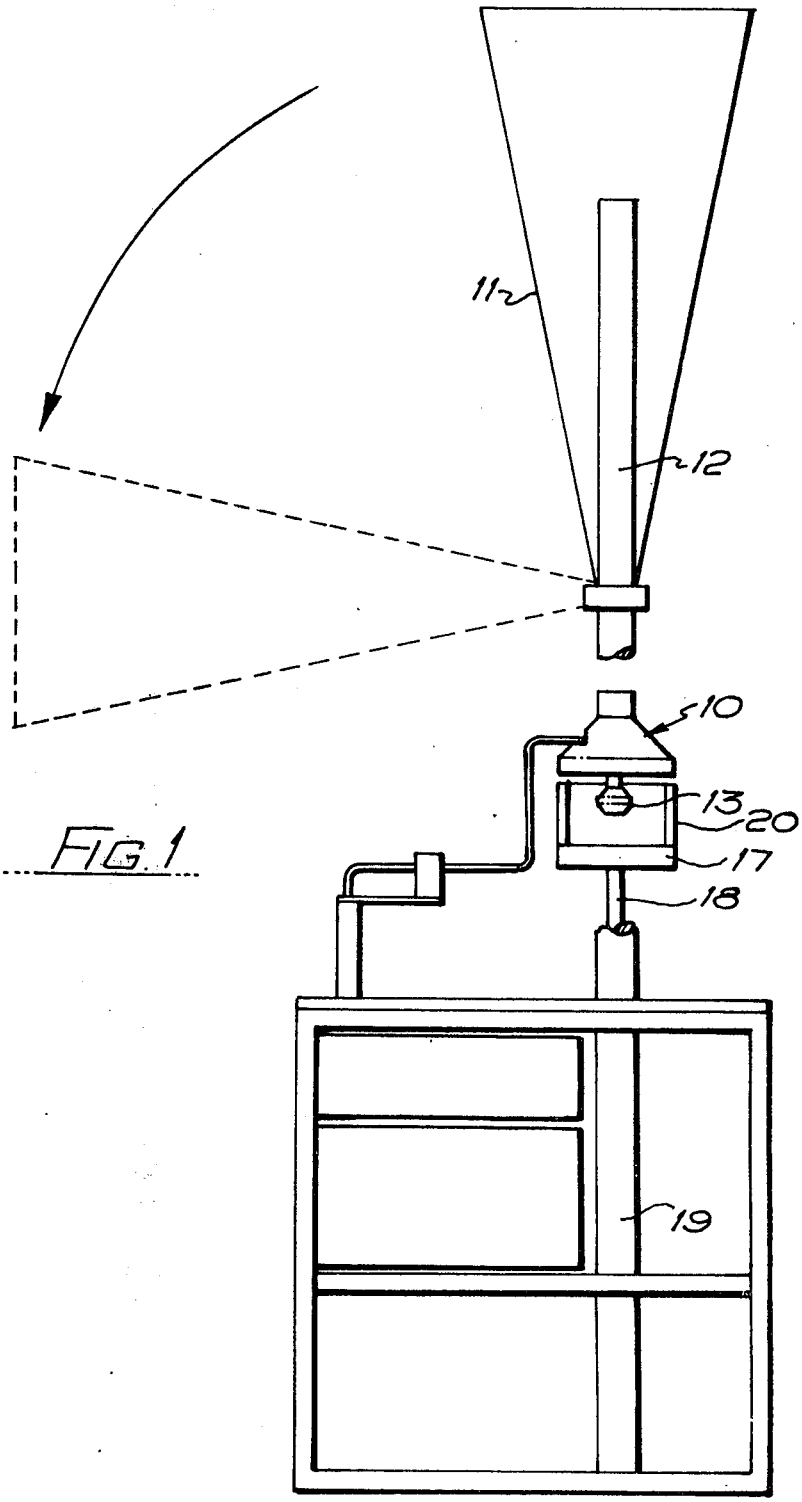
FIG. 1 is a diagrammatic general elevation of the machine.
Figure 2:
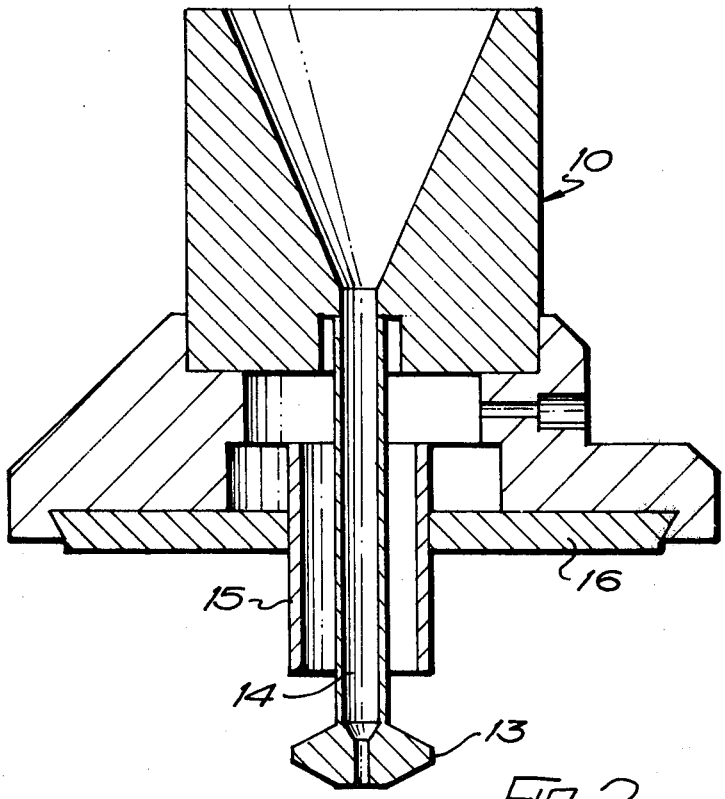
FIG. 2 is a vertical section of its filling head.

Referring firstly to FIGS. 1 and 2, the machine has a filling head 10 mounted at the lower end of a gravity feed hopper 11 which operatively contains a bulk supply of pulverulent material. Hopper 11 can be tilted about a horizontal axis on a supporting frame 12 for cleaning and servicing. Head 10 comprises a downwardly dependent filling nozzle 13 shown in detail in FIG. 2 having a central passage 14 communicating with the hopper, and a co-axial vacuum tube 15 connected to a control valve referred to hereafter. The lower face of the head 10 surrounding tube 15 is provided with a sealing pad 16 of rubber or like material for engagement with the mouth of the container to be filled. Filling nozzle 13, vacuum tube 15, and/or the entire filling head 10 can be readily interchanged to suit the type of material and/or container being handled.

Figure 4:
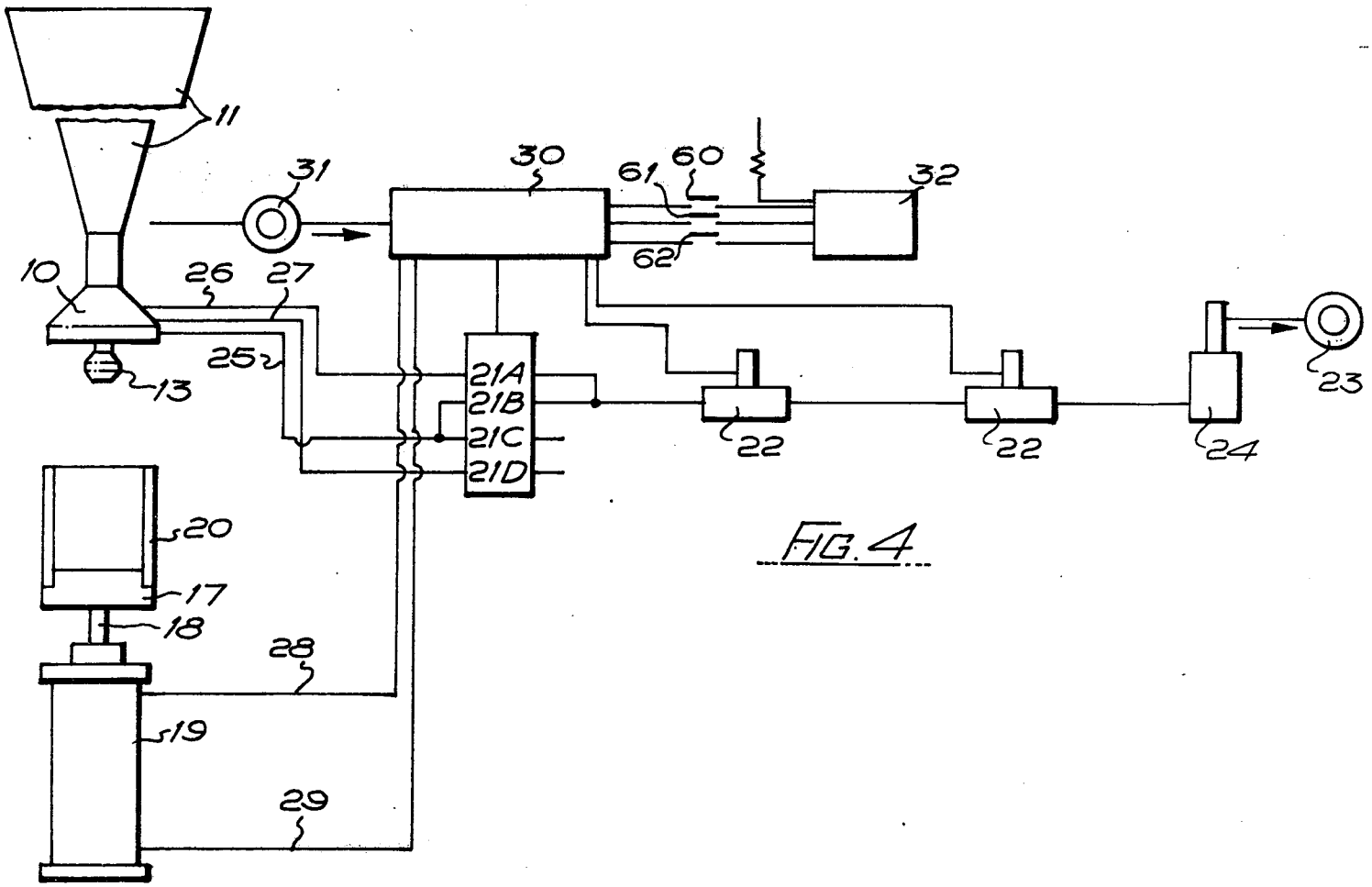
FIG. 4 is a diagram of pneumatic control and vacuum circuits of the machine.

Below the filling head is a piston table 17 (FIG. 1) mounted on the upper end of a piston rod 18 of a vertical double-acting pneumatic ram 19 (FIG. 4). Table 17 is bounded by an upstanding cylindrical wall 20 which, by the action of the ram, can be brought into abutment with the filling head 10 to constitute an airtight enclosure or vacuum bell within which will be positioned the container to be filled. Alternatively wall 20 may be attached to head 10 for abutment by table 17 when the latter is raised. A port (not shown) in head 10 forms a connection with the interior of the bell by way of a tube 25 (FIG. 4). Tubes 26, 27 form respective connections with vacuum tube 15 of head 10 for vacuum and atmosphere.

As shown in FIG. 4, the head and interior of said bell are connected through a control valve unit 21 and a pair of pressure regulated diaphragm vacuum regulating valves 22 (to be described hereafter) to a vacuum pump 23 and receiver 24. Said control valve unit 21 and regulating valves 22 are controlled by a pneumatic circuit 30 supplied by a pressure pump 31. Circuit 30 is under the control of an electric timer 32, and also includes connections 28, 29 for operating the table ram 19.

Figure 3:
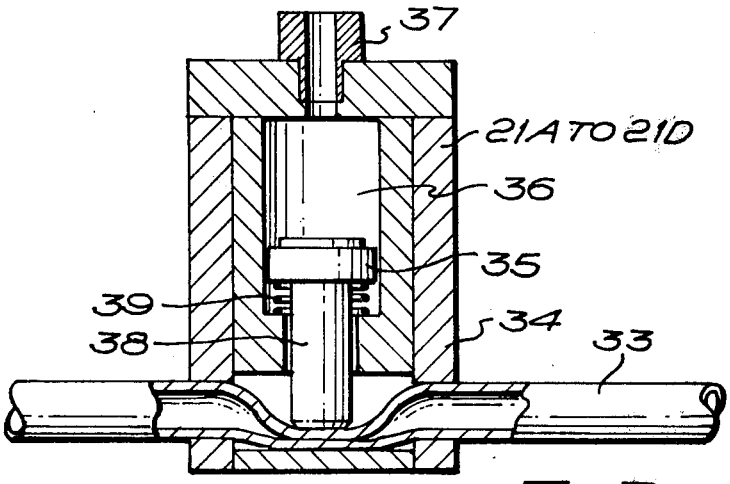
FIG. 3 is a vertical section of a shut-off valve.

Unit 21 comprises four shut-off control valves 21A, B, C and D, each as shown in detail in FIG. 3. A length of rubber tubing or other flexible duct 33 passes through an aperture in a housing 34 within which is a pneumatic piston 35 and cylinder 36. When pneumatic pressure is applied via connection 37 a plunger 38 of piston 35 squeezes duct 33 by engaging its walls so that it is quickly and positively closed. On release of the pressure plunger 35 is withdrawn under the influence of a return spring 39 acting on piston 35, and the resilient duct 33 will return to its original bore diameter. The advantages of this form of valve are its speedy and positive closure even when pulverulent material is being drawing along duct 33, and the speedy restoration of a predetermined bore dimension on opening said bore not including any obstructions such as seatings or like formations within the duct in which the material could be trapped.

Figure 5:
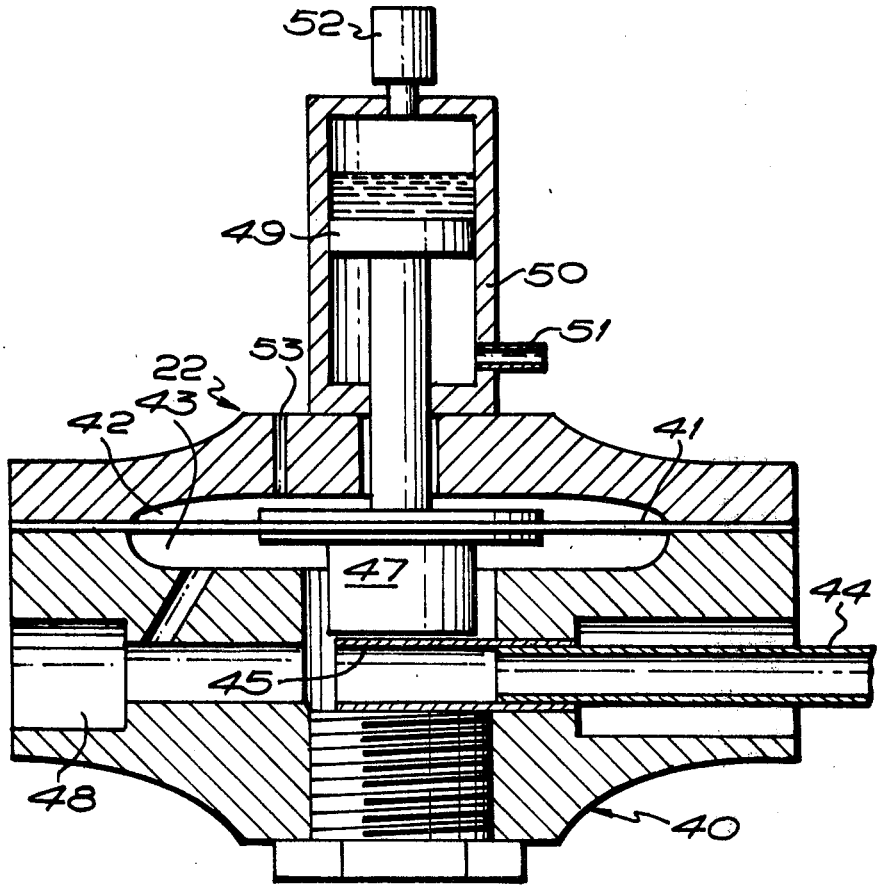
FIG. 5 is a section of a pressure regulated diaphragm valve.

The vacuum pressure applied to the head and bell by way of the control valve unit 21 is accurately maintained at a predetermined level by means of the vacuum regulating valves 22, one of which is shown in detail in FIG. 5. Said valve comprises a hollow body 40 divided by a flexible diaphragm 41 into upper and lower chambers 42, 43. Lower chamber 43 is connected to a main vacuum duct 44 leading to the vacuum pump 23. Duct 44 terminates within chamber part 43 in a short length of flexible tube 45 below a plunger 47 carried on the lower face of the diaphragm. An outlet 48 from chamber 43 is connected to the head and bell through the vacuum control valve unit 21. Two valves 22 are used, connected in series, for more accurate and reliable control of the vacuum level.

The opposite (upper) face of diaphragm 41 is linked to a piston 49 acting in a vertical cylinder 50 and which can be urged upwards under pneumatic pressure supplied to an inlet 51 through an adjustable pressure regulator of pneumatic circuit 30, the pressure level being read by a gauge (not shown) mounted on said regulator. The upper face of piston 49 is oil sealed and the upper part of cylinder 50 is vented to atmosphere through a filter 52. Application of pneumatic pressure to piston 49 will hold the plunger 47 clear of flexible tube 45 so that the valve is open, allowing the vacuum to be applied in the lower chamber 43. However, if the pressure in said chamber drops below the required vacuum level atmospheric pressure in the upper chamber 42 which is open to atmosphere through a vent 53 will overcome the force exerted by piston 49 and close the valve.

The advantages of this type of valve are speedy response, particularly when vacuum is first applied, as the flexible tube 45 will spring immediately to a fully open position so that the required level is quickly reached, precise speed control over the working stroke of piston 49, and extremely accurate control over a widely selectively variable range of operation.

In an alternative form of valve 22 the diaphragm 41 carries a needle valve on its lower face which co-acts with a seating forming the mouth of duct 44 within lower chamber 43.

The operating cycle of the machine is as follows, firstly at a rest position with the piston table 17 lowered and no vacuum being applied to the head or bell a container to be filled is positioned on the table within the cylindrical wall 20. The operating cycle is then commenced, the first stage being the raising of table 17 by the action of ram 19, the stroke and speed of operation being selectively adjustable to suit the type of container being handled (e.g. its size and rigidity). During this stage valves 21C and D (atmosphere to bell and head) are open, valves 21A and B (vacuum to head and bell) are closed.

When the container mouth has been applied to sealing pad 16 of the head the next stage is the closing of valve 21C and opening of valve 21B to apply vacuum to the bell to stabilise the container, i.e. to make sure that it is not distorted or collapsed when filling vacuum is applied to its interior. Again the timing and vacuum pressure level of this stage are selectively adjustable to suit the type of container being handled. In some cases this stage can be dispensed with, for example in filling rigid containers such as glass jars.

Figure 6:
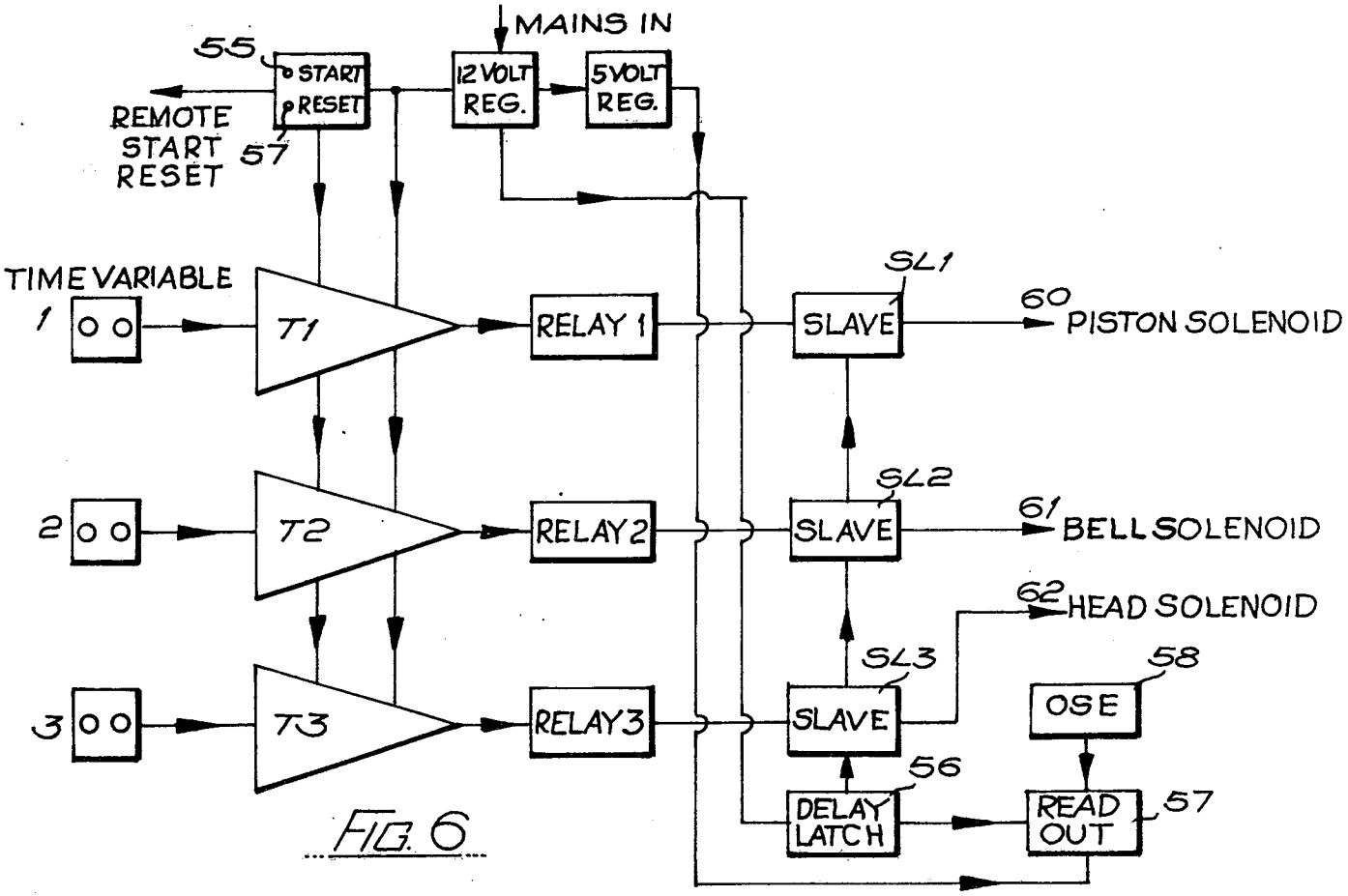
FIG. 6 is a schematic diagram of electric timing means of the control circuit.

The third stage is the fill stage where, with table 17 maintained in its raised position and stabilizing vacuum continuing to be applied to the bell through valve 21B, vacuum is also applied to the head by the opening of valve 21A and closing of valve 21D, the vacuum pressure level being regulated as described above by the regulating valves 22, this stage also being under the control of timer 32. Application of vacuum at the predetermined level and for the predetermined period draws a charge of the material into the container from hopper 11 whose quantity is closely and accurately determined by said pressure and timing. A digital read-out 57 (FIG. 6) of the timed period is provided as a check on this stage. The pressure level and timing required to achieve a charge of the desired weight or volume will have been predetermined by trial and it is found in practice that once the timing and vacuum pressure levels have been established successive filling cycles will provide charges which are accurately maintained at a constant quantity. Adjustments in the weight or volume of charge can be made by proportionate adjustment of the filling time; the vacuum pressure level being normally adjusted to the optimum setting to produce efficient operation depending on the flow characteristics of the material being handled.

Finally, on completion of the filling stage the cycle is completed by the return of table 17 to the rest position so that the filled container can be removed; vacuum being shut off by closing valves 21A, 21B and atmosphere being admitted through valves 21C, 21D. In this final stage provision is made to vacuum purge the head to ensure that any surplus material is cleared from the head and vacuum lines so that the accuracy of quantity in the subsequent filling cycle is not affected, by closing valve 21D (atmosphere to head) and opening valve 21A (vacuum to head) during downward movement of table 17 after filling is completed. This purge setting of the valves is cancelled when the next filling cycle begins.

An electronic timer (FIG. 6) operates to time the three stages referred to above — piston travel, stabilizing, and filling, through relays ("RLY1, 2 and 3") and self-latching slaves SL1, 2 and 3. The operating cycle is started manually by a push-button 55 (or may alternatively be started automatically following a preceding cycle) on which RLY1 is energised, together with its associated slave SL1 which is self-latching and in turn actuates a solenoid 60 controlling the piston table ram. When this first stage is finished RLY1 de-energieses but its slave SL1 remains latched, and the next stage begins automatically with the energisation of RLY2 and latching of its slave SL2 operating a solenoid 61 applying the stabilizing vacuum to the bell. On completion of this stage RYL3 is energised, latching its slave SL3 and operating a solenoid 62 controlling the filling head and also a delay latch 56 which starts the read-out 57 which is driven by a free running oscillator 58. On completion of the filling stage RLY3 is de-energised stopping the read-out and cutting off a 12 volt supply to the slaves so that the three solenoids are de-energised. Delay latch 56 resets the read-out to zero. A reset button 57 is provided which can override the timing device and stop the process in any stage of operation.

While a single head machine has been described for simplicity it is to be understood that multiple head machines are contemplated for large scale filling operations, e.g. arranged as a rotary filling machine.

Experiments have shown that accuracy of charge quantity of + or $-\frac{1}{2}\%$ by weight can be readily achieved. Whatever the selected size of charge a maximum variation of 1 Gram. light or heavy can be readily achieved and it is believed that this standard of accuracy is as good or better than most known types of filling machines, many of which are far more complex than that described above.

While the invention has been described in relation to the packaging or batching of pulverulent materials, it is contemplated that it may also have application to packaging or batching of other fluent materials, e.g. liquids or possibly pastes.

What we claim is:

1. A method of charging a container with a predetermined quantity of a fluent material including the steps of connecting the container to a bulk supply of the material, applying a vacuum within the container at a predetermined pressure level and for a predetermined period of time to draw a charge of material into the container, the quantity of said charge being determined as a function of said pressure level and said period, and vacuum purging surplus material from the connection between the container and the bulk supply on completion of a filling operation and before commencement of a succeeding filling operation.

2. A method as in claim 1 including the step of applying a vacuum to the exterior of the container during filling.

3. Apparatus for charging a container with a predetermined quantity of a fluent material including a filling head operable to connect a mouth of the container with a bulk supply of the material, means for applying a vacuum within the container at a predetermined pressure level whereby material is drawn into the container from the supply, electronic timing means for controlling the period of time during which said vacuum is applied, said pressure level and said period being preselected so as to determine the size of the charge of material, and means for purging surplus material from the filling head upon completion of the filling operation and prior to subsequent filling of another container.

4. Apparatus as in claim 3 including a vertically movable table selectively operable to carry the container into abutment with the filling head.

5. Apparatus as in claim 4 including means defining an air tight enclosure within which the container is located for filling, and means for applying the vacuum to the exterior of the container within the enclosure during filling.

6. Apparatus as in claim 3 including at least one shut-off valve actuated in response to the timing means, said valve comprising a length of flexible ducting located in a housing, and a plunger carried on the housing and movable to squeeze said duct and so close the valve.

7. Apparatus as in claim 6, wherein said plunger is actuated by a pneumatic cylinder and piston responsive to the timing means.

8. Apparatus as in claim 3 including at least one vacuum regulating valve, said valve comprising a hollow body divided by a flexible diaphragm into first and second chambers, the first being open to atmosphere and the second being operatively interconnected between the filling head and means for creating the vacuum; a closure element carried on said diaphragm for co-operation with a passage leading to the latter means within the second chamber; and a fluid pressure actuated piston linked to the diaphragm to act in parallel with the atmospheric pressure in the second chamber, whereby, the vacuum pressure level is maintained at a predetermined level determined by the fluid pressure applied to the piston.

9. Apparatus as in claim 8, wherein said piston is pneumatically operated through an adjustable pressure regulator.

10. Apparatus as in claim 8, wherein said passage is defined by a length of flexible tubing, and the closure element is a plunger.

11. Apparatus as in claim 3 including a plurality of filling heads.

* * * * *